United States Patent [19]

Hansen

[11] 4,251,180

[45] Feb. 17, 1981

[54] ROLL-CHANGING APPARATUS

[75] Inventor: Manfred W. Hansen, Düsseldorf, Fed. Rep. of Germany

[73] Assignee: Sack GmbH, Düsseldorf, Fed. Rep. of Germany

[21] Appl. No.: 855,885

[22] Filed: Nov. 30, 1977

[30] Foreign Application Priority Data

Dec. 3, 1976 [DE] Fed. Rep. of Germany ..... 2654768

[51] Int. Cl.³ ..... B66F 9/04

[52] U.S. Cl. ..... 414/560; 72/238

[58] Field of Search ..... 212/8 R, 9, 10, 11, 212/13, 14, 18, 71; 214/75 H, 394, DIG. 4; 104/95, 109; 72/238; 414/560, 589

[56] References Cited

U.S. PATENT DOCUMENTS

| | | | |
|---|---|---|---|
| 2,433,459 | 3/1969 | Logan | 212/9 X |
| 3,905,485 | 9/1975 | Shumaker | 214/DIG. 4 X |

*Primary Examiner*—Robert G. Sheridan

*Attorney, Agent, or Firm*—John J. Dennemeyer

[57] ABSTRACT

A travelling gantry is used for exchanging the working rolls of roll stands. A carriage is mounted on a cross member of the gantry and a roll extraction device with roll receiving rotatable sleeves therein is suspended from the carriage in a vertically adjustable manner. The cross member of the gantry is preferably a box girder of which the lower wall has lateral projections providing guide surfaces engaging in an inverted T-section groove of the carriage.

6 Claims, 2 Drawing Figures

ROLL-CHANGING APPARATUS

Figure 1:
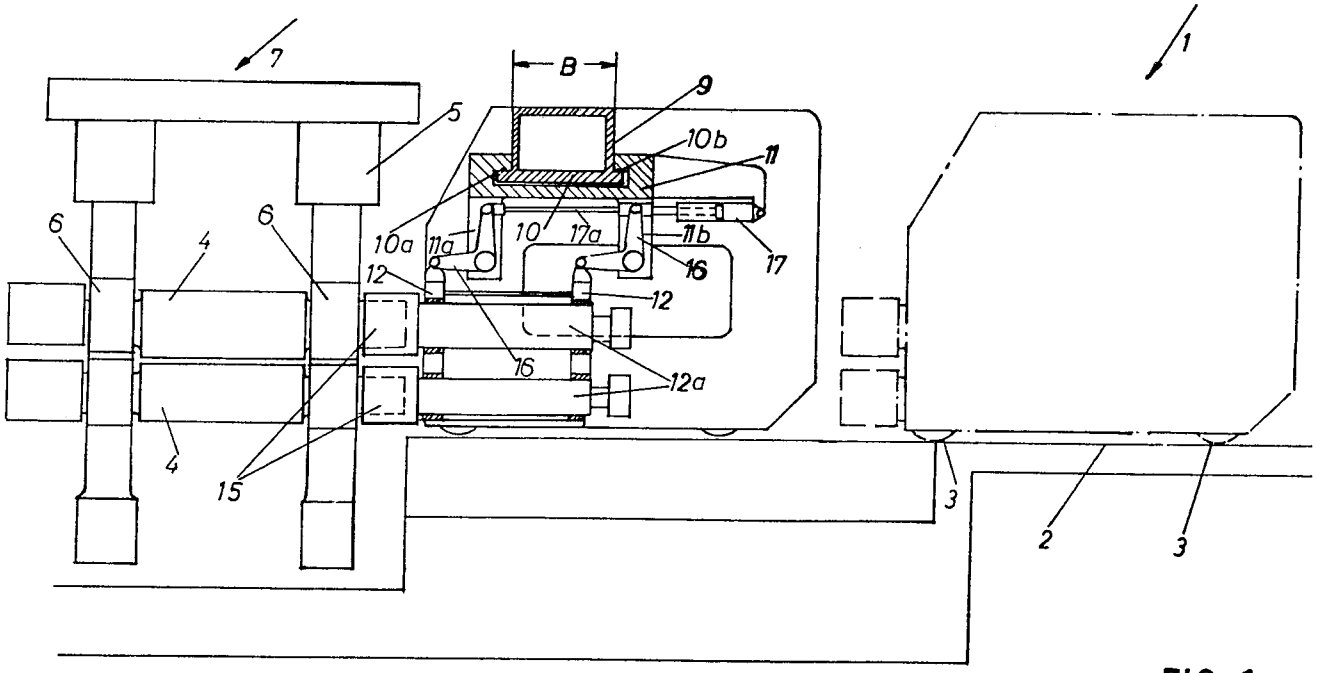

The invention relates to an apparatus for exchanging the working rolls of roll stands, in particular four-high roll stands, with a changing machine located in front of the roll stand and able to travel in the axial direction of the working rolls, which machine comprises a roll extraction device preferably with two removal sleeves mounted to rotate, for receiving the working rolls to be exchanged, the removal sleeves being located at a fixed distance apart, but being vertically adjustable in their entirety.

It is known that in their basic construction, roll stands comprise working rolls mounted in mounting members and if necessary support rolls as well as roll adjustment devices and a roll relieving device, in which case, above all, the working rolls have to be exchanged relatively frequently on account of constant wear. Today, a plurality of measures are implemented in order to reduce the periods of stoppage of roll stands and thus to reduce the periods of stoppage of rolling trains consisting of several roll stands, when the working and/or support rolls are exchanged. Thus, a plurality of known constructions exist, but which all involve one or more unsatisfactory secondary phenomena for the rolling mill engineer. Recurrent complaints are: uneven mill floor, no free space in front of the roll stand during operation, extensive foundation and other under floor work during reconstruction, numerous operations and alterations on the roll stand itself. Under certain circumstances, these drawbacks are all tolerated simultaneously in order to provide mechanization or even automation of the roll changing operation.

In particular, it is usual to change the rolls of high production roll stands or rolling trains with more or less expensive changing machines. The task to be fulfilled by changing machines is always the same, namely to remove old rolls, move them from the extraction line, deposit them, supply new rolls and insert them in the roll stand. After the completed roll changing operation, the changing machine should move the old rollers out of the region of the stand and clear the immediate vicinity.

An apparatus of the afore-described type is known (c.f. German Offenlegungsschrift No. 1,913,771, to which U.S. Pat. No. 3,618,355 corresponds) and in its basic construction comprises a mounting and removal device operating in the axial direction of the working rolls, in the form of a roll removal carriage and also, for the purpose of more rapid roll changing, a roll store able to travel or move in the rolling direction. The drawbacks of this device are constituted not only by the high expenditure and increased space requirement, but also by the fact that for exchanging the working rolls, the relatively large and heavy guide plate constructed as a roll store has to be raised by a swinging movement out of the plane of the mill floor, and moved in the rolling direction by the necessary extent of the deposited new rollers. When a rolling train consists of several stands, it is necessary to move several heavy guide plates in all.

Accordingly, the invention intends to obviate the drawbacks of known roll changing apparatus and not to locate any part necessary for changing rolls or for moving a set of rolls in the region of the mill floor, but nevertheless to be able to service rolling mills of very flat construction.

This object is fulfilled according to the invention due to the fact that the changing machine able to travel in front of the roll stand in the axial direction of the working rolls as a gantry vehicle is constructed with a crossbeam spanning at least three times the width of a dismantled set of rolls and that the cross-beam is constructed as a guide for an overhead conveying member similar to a trolley, which is able to move in both directions in which the rolled stock travels, which conveying member supports a roll extraction device known per se. Due to the latter, a shifting or driving mechanism is no longer required in the immediate vicinity of the mill floor, because neither the guide plates nor other forms of roll store able to move on the mill floor are provided for the sets of rolls. On the contrary, this activity is taken over by the conveyor member supporting the roll extraction or roll handling device, which must be able to move on the crossbeam of the gantry vehicle to such an extent that firstly the preparation of a reserve set of rolls adjacent one side of the removal area of the used set of rolls is possible and on the other hand after the removal of the set of rolls, the latter can be deposited adjacent the other side of the removal area, the result of which is that the possible travel of the conveying member and thus the length of the crossbeam must amount to at least three times the width of a complete set of rolls.

A further embodiment of the invention provides that the cross-beam connecting the two side walls of the gantry vehicle is a hollow girder and compirses a lower wall projecting uniformly on both sides with respect to the width of the remaining girder, in which case the projecting wall surfaces are constructed as guides for the conveying member surrounding the lower wall in the shape of a c and that the travel of the gantry vehicle extends as far as the roll grinding plant adjoining the rolling train, which is therefore appropriate because in modern multi-stand rolling trains, the roll grinding plant or turning plant extends parallel to the rolling train.

Figure 2:
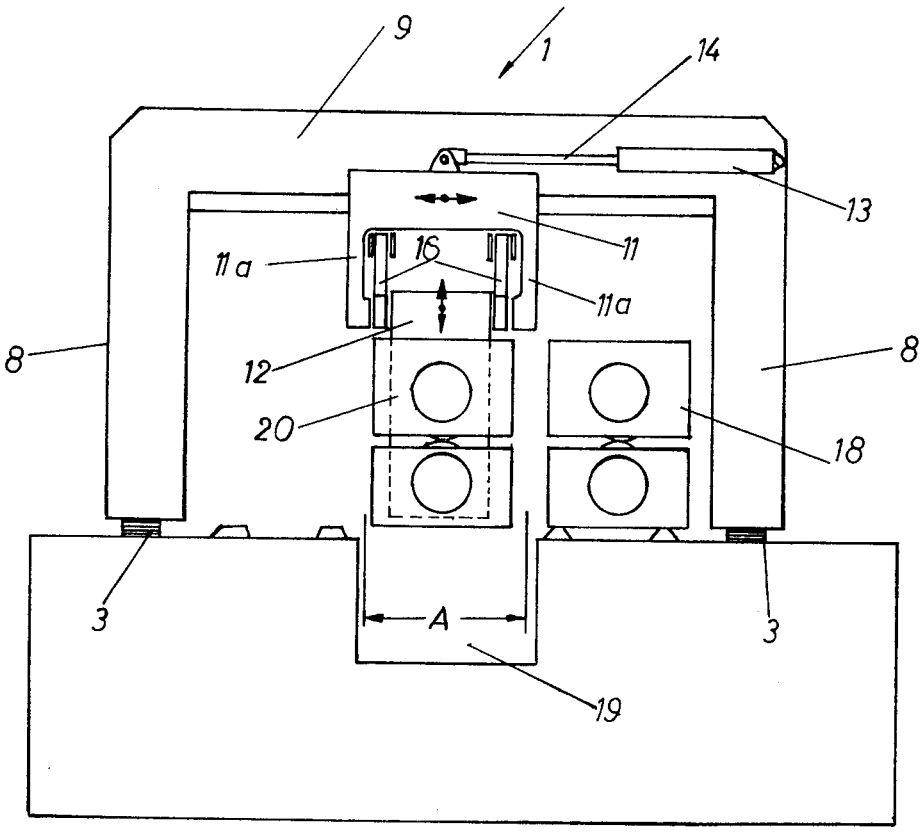

The invention is described in detail hereafter with reference to the drawings:

FIG. 1 shows the gantry vehicle in an intermediate position and in section in the changing position in front of a roll stand illustrated diagrammatically and FIG. 2 is a view of the gantry vehicle with a set of rolls dismantled from the roll stand, seen in the axial direction of the rolls.

The gantry vehicle 1 illustrated in FIG. 1 is able to travel in the track 2 on wheels 3 into a changing position, in the axial direction of the working rolls 4 and a roll stand 5. The roll stand is provided with mounting members 6 for the working rolls 4 mounted therein, with support rolls (not shown in detail) together with their mounting members, with a hydraulic roll-relieving device (not shown) and with roll-adjusting devices 7 shown only in outline.

A gantry vehicle 1 is associated with each roll stand 5 of a rolling train for changing the rolls, the side walls 8 of which vehicle are interconnected by a crossbeam 9. The crossbeam 9, in this case constructed as a hollow girder, is thus dimensioned as regards its overall length such that the crossbeam determining the span width and thus the working range of the gantry vehicle 1 spans at least three complete sets of rolls. A conveying member 11, which supports a roll-extraction device is suspended from the crossbeam on the lower support wall 10, which projects uniformly beyond the width B of the crossbeam 9 on both sides and thus forms guide surfaces 10*a*, 10*b* such that the lower wall 10 is surrounded in the shape of a c and the conveying member comes to rest on the surfaces 10*a*, 10*b*. The piston rod 14 of a hydraulic cylinder 13 engages the conveying member 11 and is able to move the latter in or against the direction of which the rolled stock travels, depending on its actuation. The conveying member 11 has two pairs of downwardly directed struts 11*a*, 11*b*, on whose lower ends pairs of angle levers 16 are mounted. Piston rods 17*a* of a hydraulic cylinder 17 respectively engage in pairs on the upwardly directed arms of these angle levers so that the angle levers can be moved in synchronism.

Suspended from the horizontal pairs of arms of the angle levers 16 are two bearing brackets 12, which are provided with two bores located one above the other for receiving two parallel rigid shafts 12*a*, which each support a removal sleeve 15 at their ends adjacent the roll stand. The centre-to-centre distance of the shafts 12*a*, corresponds to the centre-to-centre distance of the working rolls 4 to be removed, in the removal condition. The afore-described roll extraction device is known per se, for example, as shown in U.S. Pat. No. 3,618,355. The method of operation of the roll-changing device described is as follows:

Firstly, a new set of working rolls 18 is conveyed by the gantry vehicle 1 to a position in front of the roll stand 5 and is deposited on the mill floor or cover plate for the removal pit 19 of the support rollers, in a region at the side of the adopted removal and mounting area A, which amounts to somewhat more than the total width of a complete set of working rolls. Then, the cylinder 13 is actuated and the conveying member 11 is moved on the crossbeam 9 in the direction of travel of the rolled stock, into a position in which the roll-extraction device with the removal sleeves 15 is located exactly in front of the used set of working rolls 20 of the roll stand (FIG. 2). Then the used working rolls are removed from the roll stand in that the sleeves 15 are placed on the ends of the roll journals and clamped hydraulically. In order that it is even possible to service old rolling trains, which do not have a defined vertical position of the rolls, the vertical position of the sleeves can be adjusted by way of the cylinders 17 and the lever system 16 guided positively in parallel. Also, since the position of the drive couplings with respect to each other is frequently no longer defined, then either both sleeves 15 in the roll removal device 12 are constructed to rotate or each sleeve can be rotated individually. Thus, it is always possible to achieve a position in which coupling is possible, which is necessary above all when the sleeves cannot be clamped hydraulically.

After removing the used working rolls, for which the gantry vehicle 1 is moved into the position shown in dot-dash lines, the conveying member 11 is moved further in the rolling direction and the used set of working rolls 20 is deposited on the side of the removal and mounting area A which is still free. After the removal sleeves 15 have been released, the vehicle 1 is moved back somewhat further, in order to release the working roll journals. Then, the conveying member with the removal and mounting device is once more moved in the other direction, so that the previously prepared set of working rolls 18 can be picked-up and moved into the mounting area A in front of the roll stand. After completed mounting of the new set of rolls, the used rolls 20 are once more picked up and transported by the gantry vehicle directly to the roll grinding plant provided parallel to the rolling mill.

What is claimed is:

1. Apparatus for exchanging the working rolls of a roll stand, comprising:

a gantry movable in the direction of the axis of the rolls to be exchanged, said gantry having an interior opening of at least three times the width of the rolls to be exchanged, and an upper cross-member;

a carriage mounted for movement along said cross-member in a direction transverse to the axis of said rolls to be exchanged;

means suspended vertically-adjustably beneath said carriage for extracting said rolls from said roll stand; and means for suspending said roll-extracting means beneath said carriage such that said roll-extracting means is vertically-adjustable, wherein said suspending means comprises a plurality of levers operatively connected at respective first pivot points to said carriage and at respective second pivot points to said roll-extracting means, and means for rotating said levers to effect vertical adjustment of said roll-extracting means relative to said carriage.

2. The apparatus of claim 1, wherein said roll-extracting means comprises two roll-receiving sleeves disposed in a fixed, vertically-spaced relationship.

3. The apparatus of claim 1, wherein side upper cross member comprises a hollow box girder having said walls and a lower wall projecting laterally outwardly of said said walls to form guide surfaces for said carriage, said carriage having an upper portion in the form of a slide groove for mating with said guide surfaces.

4. The apparatus of claim 3, wherein said hollow box girder has an inverted T-shaped cross-section, and said upper carriage portion has a C-shaped cross-section.

5. The apparatus of claim 1, further comprising a rectilinear track positioned beneath said gantry to facilitate movement of said gantry in the direction of the axis of said rolls to be exchanged.

6. The apparatus of claim 1, wherein said roll-extracting means comprises a pair of bearing brackets, each said bearing bracket having two bores, the bores located one above the other; a pair of shafts journalled rotatably in the bearing bracket bores; and a sleeve supported at one end of each of the shafts, whereby each of said sleeves is independent rotatable relative to said bearing brackets.

* * * * *